US005564843A

United States Patent [19]

Kawaguchi

[11] Patent Number: 5,564,843

[45] Date of Patent: Oct. 15, 1996

[54] REFLECTIVE PRINT LABEL AND METHOD OF PRODUCING THE SAME

[75] Inventor: Takashi Kawaguchi, Aichi-ken, Japan

[73] Assignee: Brother Kogyo Kabushiki Kaisha, Nagoya, Japan

[21] Appl. No.: 345,692

[22] Filed: Nov. 21, 1994

[30] Foreign Application Priority Data

Dec. 17, 1993 [JP] Japan ..... 5-317739

[51] Int. Cl.[6] ..... B41J 35/28

[52] U.S. Cl. ..... 400/208; 428/327; 156/540

[58] Field of Search ..... 400/208, 207, 400/196, 208.1, 223, 487, 120.01; 156/384, 387; 428/908, 908.1, 325, 409, 327, 328, 329, 334, 335, 337, 339, 343, 344, 347, 352

[56] References Cited

U.S. PATENT DOCUMENTS

| | | | |
|---|---|---|---|
| 4,286,077 | 8/1981 | St. Clair et al. | 525/237 |
| 4,585,679 | 4/1986 | Karabedian | 428/517 |
| 4,886,774 | 12/1989 | Doi | 427/150 |
| 4,927,278 | 5/1990 | Kuzuya et al. . | |
| 5,122,413 | 6/1992 | Ohno et al. | 428/319.9 |
| 5,129,974 | 7/1992 | Aurenius | 156/64 |
| 5,153,042 | 10/1992 | Indrelie | 428/40 |
| 5,168,814 | 12/1992 | Kuzuya et al. . | |
| 5,272,127 | 12/1993 | Mandolt et al. | 503/207 |
| 5,300,395 | 4/1994 | von Trebra et al. | 430/143 |
| 5,326,182 | 7/1994 | Hagstrom | 400/223 |
| 5,372,987 | 12/1994 | Fisch et al. | 428/327 |
| 5,409,883 | 4/1995 | Larshus et al. | 400/240 |
| 5,460,874 | 10/1995 | Rao | 428/327 |
| 5,489,359 | 2/1996 | Yamane | 156/540 |

*Primary Examiner*—Eugene H. Eickholt
*Attorney, Agent, or Firm*—Oliff & Berridge

[57] ABSTRACT

A reflective label is produced by forming a print image on one surface of a cover film of a transparent resin of polyester or the like with a thermal head using an ink ribbon according to a thermal transfer printing method, and then, sticking the surface of the cover film with the print image formed thereon, to the reflective surface of a reflective double-coated adhesive tape, formed of a reflective ink layer including light scattering particles of glass beads or the like and a vapor deposited metallic layer.

20 Claims, 6 Drawing Sheets

REFLECTIVE PRINT LABEL AND METHOD OF PRODUCING THE SAME

BACKGROUND OF THE INVENTION

1. Field of the Invention

The present invention relates to a method of producing reflective labels with desired letters, picture images, and the like recorded thereon.

2. Description of the Related Art

Printing apparatuses, such as printers, typewriters, and word processors, of a thermal transfer printing system have been recently developed and put to a wide variety of uses from small, personal use to business use.

Thermal transfer printing is achieved by heating required ones of a number of heating elements provided on a thermal head, while a thermal transfer ink ribbon is put into close contact with predetermined printing paper by the thermal head, thereby causing the portion of the heat melting ink in contact with the heating elements via the backing member of the ink ribbon to be melted and transferred to the printing paper.

On the market, there are a number of apparatuses for producing labels and the like with desired letters and picture images printed on tack paper, tack film, and the like utilizing the above described thermal transfer printing method.

There are increasing demands for labels designed to provide excellent visibility. Hence, there is proposed a label using, as the above mentioned tack film, a reflective film including an ink layer reflecting light beams and applied with an adhesive agent on the backside thereof and having letters and picture images formed on the surface of the reflective film by the thermal transfer printing method.

The above described reflective film has quite a high possibility of being used outdoors, in factory sites, in construction work fields, and so on, because of its improved visibility and other characteristics. Therefore, excellent resistances such as weather-, abrasion-, heat-, and chemical-resistance are required for such reflective films.

Accordingly, there is also devised a label intended for improved printability and durability of the print by providing a chemical layer mainly containing polyester or the like on the reflective film so that the surface of the reflective film easily accepts the heat-melted ink of the ink ribbon.

However, even if an image receiving layer is provided on the surface of the reflective film, since the print image is exposed on the surface, there are limits in the weather-resistance and abrasion-resistance of the image receiving layer against such external agents. Therefore, under such severe usage conditions as outdoors, in factory sites and in fields of construction work, it is impossible for the print image to maintain its original state for long. Most of such image receiving layers are not provided with chemical-resistance.

SUMMARY OF THE INVENTION

It is an object of the present invention to provide a method of producing a reflective label which is excellent in weather-, abrasion-, heat-, and chemical-resistance.

In order to attain the above mentioned object, a method for producing a reflective label of the invention comprises a first process, with the use of an ink ribbon and a cover film of a transparent resin, for forming a print image on one surface of the cover film by thermally transferring ink applied to the ink ribbon to the surface of the cover film with a thermal head; and a second process, with the use of a reflective double-coated adhesive tape having a reflective surface reflecting light, formed of a reflective ink layer having light scattering particles and a vapor deposited metallic layer, and the cover film with the print image formed thereon in the first process, for sticking together the surface of the cover film with the print image formed thereon and the reflective surface of the reflective double-coated adhesive tape.

In order to attain the above mentioned object, a reflective label of the invention comprises a cover film of a transparent resin with a print image formed on one surface thereof by thermal transfer of ink of an ink ribbon to the surface with a thermal head, and a reflective double-coated adhesive tape adhered on the surface of the cover film with the print image formed thereon, formed of a reflective ink layer, including light scattering particles, and a vapor deposited metallic layer.

The above mentioned cover film may be a resin film in which an ultraviolet absorbent is dispersed or dissolved.

The above mentioned reflective double-coated adhesive tape may be formed of a backing member, the reflective ink layer formed on one surface of the backing member, the vapor deposited metallic layer formed on the reflective ink layer, an adhesive layer applied to and formed on the vapor deposited metallic layer, and peel paper stuck onto the adhesive layer, and further, a transparent adhesive layer applied to and formed on the surface of the backing member opposite to the surface on which the reflective ink layer is formed.

The above mentioned reflective print label may be that produced by using the ink ribbon, the reflective double-coated adhesive tape, and the cover film contained, in a state wound on the respective spools, in a tape containing cassette to be removably loaded in a tape printing apparatus.

In the producing method of a reflective label of the invention comprising the above described means, a transferred image of letters and picture images is formed by causing ink in a thermal transfer ribbon to be thermally transferred, by means of a thermal head, to the surface of a cover film formed of a transparent film. Then, the surface of the cover film on which the image has been formed and the reflective surface of the reflective double-coated adhesive tape are stuck together, whereby a reflective label is produced.

The reflective label of the invention having the above described structure is improved in the visibility of the label by having a reflective ink layer including light scattering particles and a vapor deposited metallic layer, and further, durability of the transferred image is enhanced because the transferred image formed of ink is sealed up within the label.

The method of producing a reflective tape according to the invention comprises sticking a double-coated adhesive tape formed of a reflective ink layer including glass beads and a vapor deposited metallic layer to the surface of a transparent resin cover film, on which a print image is formed by a thermal transfer printing method. The method can provide a reflective label highly excellent in weather-, abrasion-, heat-, and chemical-resistance.

BRIEF DESCRIPTION OF THE DRAWINGS

A preferred embodiment of the present invention will be described in detail with reference to the following figures, wherein.

DETAILED DESCRIPTION OF THE PREFERRED EMBODIMENTS

Description as related to preferred embodiments according to the invention will be given in detail with reference to the accompanying drawings.

1. Structure of Reflective Label 30

Figure 1:
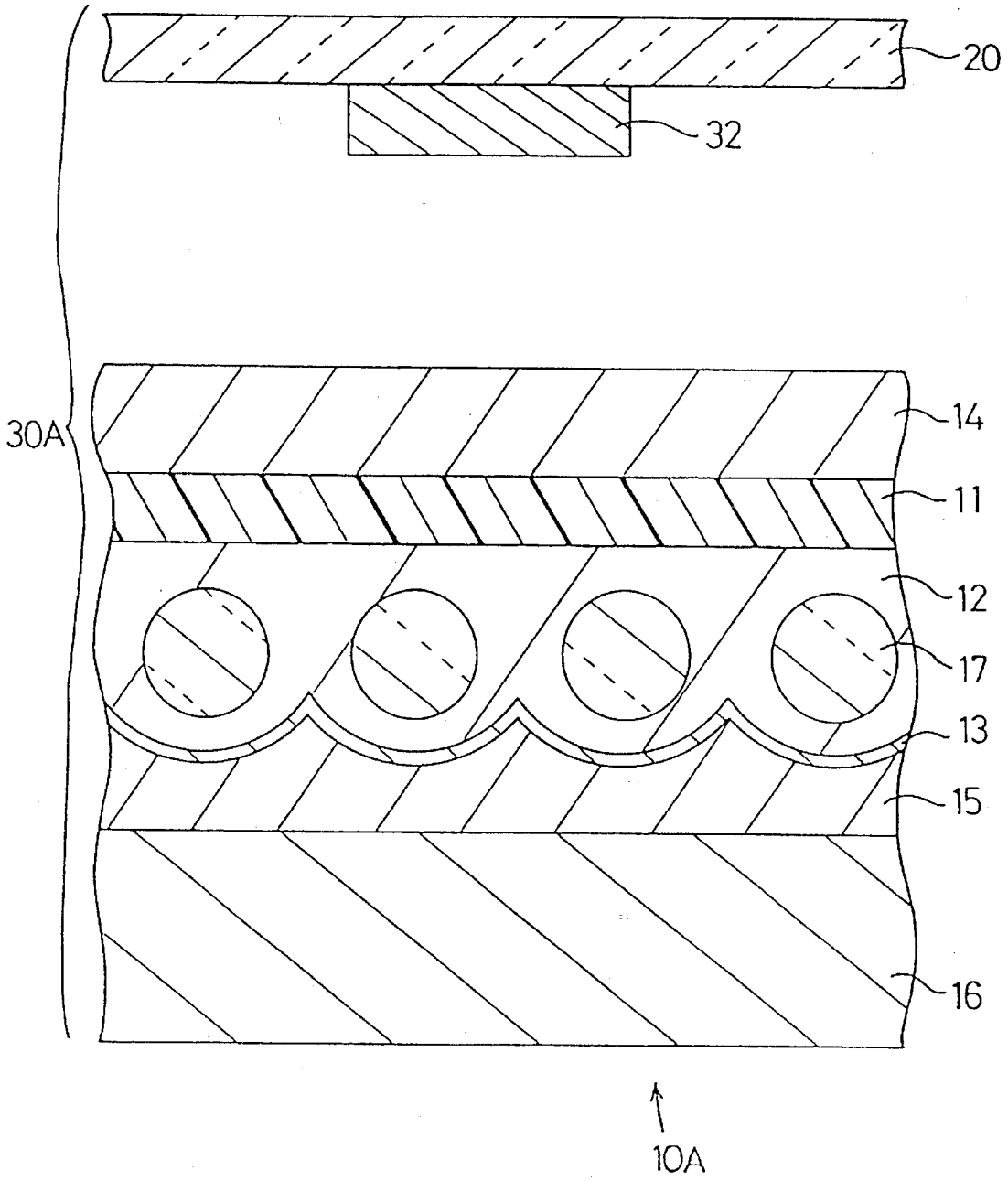
FIG. 1 is a sectional view explanatory of an example of a reflective double-coated tape.

FIG. 1 is a sectional view schematically showing a reflective label 30A in a preferred embodiment of the invention. The reflective label 30A is formed of a reflective double-coated adhesive tape 10A and a cover film 20 containing an ultraviolet absorbent. The reflective double-coated tape 10A is formed, as shown in FIG. 1, of a base material sheet 11, which is made of a transparent resin film and provided with an adhesive layer 14 formed on one surface thereof (above in FIG. 1) by application of a non-color, transparent adhesive thereto. On the other surface of the base material sheet 11 (below in FIG. 1), there is formed a reflective ink layer 12 made up of light scattering particles 17 with diameters ranging from 30 μm to 100 μm, a highly transparent resin binder, and a coloring agent. Over the reflective ink layer 12, there is formed a vapor deposited metallic layer 13 such as of aluminum or the like to a predetermined thickness, and a peel paper 16 is attached to the vapor deposited metallic layer 13 via an adhesive layer 15.

In the reflective ink layer 12, pigment is dispersed or dye is dissolved as a coloring agent for coloring the reflective ink layer 12. Preferably, the coloring agent is present in an amount of 50 wt % or less in the reflective ink layer. In the reflective ink layer 12, there are contained light scattering particles 17, which cause light to be scattered in cooperation with the coloring agent so that the color of the coloring agent looks better. By this is meant that the overall color quality is improved because incoming light can be reflected in a straight manner without irregular reflection. The light scattering particles 17 are contained in an amount of 20–70 wt %, more preferably 30–50 wt %, in the reflective ink layer 12. As materials of the light scattering particles 17, glass beads, quartz beads, and highly transparent resin particles, for example, can be mentioned. As the binder for binding the coloring agent and the light scattering particles, such resins having high transparency as acrylic, ionomer, TPX (polymethylpentane), polystyrene, styrene-acrylic, polyester and mixtures thereof can be mentioned as examples. The reflective ink layer may be formed on the base material sheet 11 to have a total thickness of 50–200 μm.

The vapor deposited metallic layer 13 provided on the reflective ink layer 12 may be deposited by evaporation generally to a thickness of 1–20 nm. The vapor deposited metallic layer 13 may be, for example, aluminum, silver or tin. Preferably, the vapor deposited metallic layer is aluminum.

The base material sheet 11 corresponding to the backing member of the invention preferably has high transparency. Examples of suitable materials include polyester, polypropylene, polyethylene, polycarbonate, polystyrene and mixtures thereof. Generally, a base material sheet 11 processed to a thickness ranging from 6 μm to 100 μm may be used.

As the adhesive layer 14 formed on the base material sheet 11, an acrylic adhesive agent having very high transparency, because incident light and reflected light pass therethrough, and having good weather-resistance and chemical-resistance is preferably used.

As the adhesive agent to be applied to the vapor deposited metallic layer 13 to form the adhesive layer 15, an adhesive agent such as a solvent type acrylic adhesive, a rubber type adhesive, a water-soluble adhesive, a hot melt adhesive, or an emulsion type adhesive, for example, can be used.

As the peel paper 16, glassine paper or wood free paper coated with silicone or polyethylene, or polyethylene terephthalate (PET) coated with silicone or polyethylene may be used.

On the other hand, as the cover film 20 to be stuck onto the reflective double-coated adhesive tape 10A, a cover film formed of a transparent resin and having a thickness of 10–100 μm, more preferably 25–75 μm, may preferably be used for obtaining good abrasion-resistance. In addition to very high transparency, the cover film 20 preferably has weather-, chemical-, and heat-resistances because it is constantly exposed to the external environment. As examples of the resin film meeting the above mentioned conditions, a film of polyester (polyethylene terephthalate, polyethylene naphthalate), polyvinylidene chloride, polyimide, polyether ketone, and mixtures or the like can be mentioned.

Further, as ultraviolet absorbent that can be dispersed in the cover film 20, a benzotriazole derivative is suitable. As examples of the benzotriazole derivative, the following compounds can be used. That is, 2-(5-methyl-2-hydroxyphenyl) benzotriazole, 2-[2-hydroxy-3,5-bis(α, α-dimethylbenzyl) phenyl]-2H-benzotriazole, 2-(3,5-di-t-butyl-2-hydroxyphenyl) benzotriazole, 2-(3-t-butyl-5-methyl-2-hydroxyphenyl)-5-chlorobenzotriazole, 2-(3,5-di-t-butyl-2-hydroxyphenyl)-5-chlorobenzotriazole, and 2-(3,5-di-t-amyl-2-hydroxyphenyl) benzotriazole, for example, can be mentioned. Preferably, the ultraviolet absorbent may be present in an amount of 10 wt % or less in the cover film.

Figure 2:
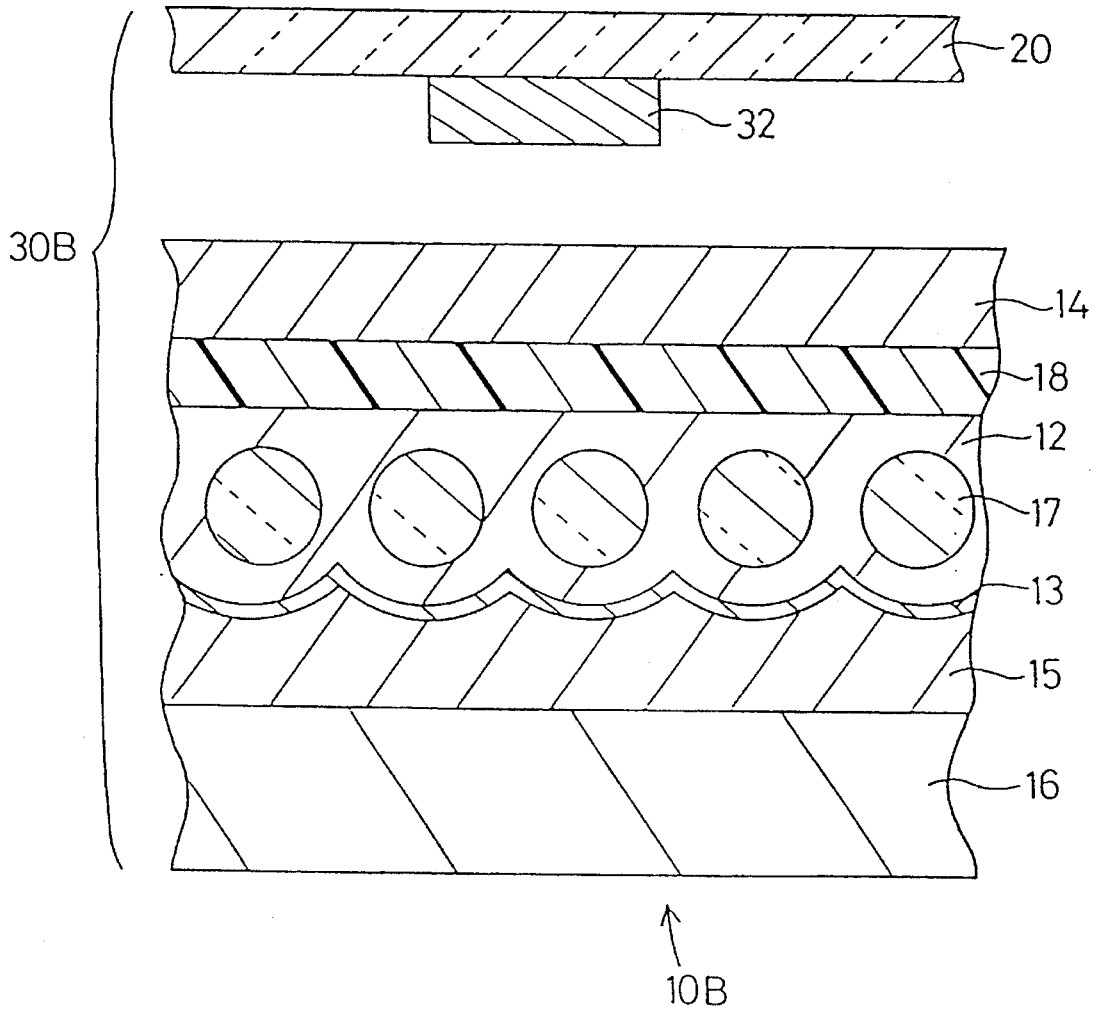
FIG. 2 is a sectional view explanatory of another example of a reflective double-coated tape.

As another embodiment, a reflective label 30B is formed of a reflective double-coated tape 10B and a cover film 20, as shown in FIG. 2. The reflective double-coated tape 10B lacks a base material sheet 11. Instead, it has a surface protecting resin layer 18 of an acrylic resin or the like. This type can also be used as a reflective double-coated adhesive tape by applying an adhesive agent to both the vapor deposited metallic layer 13 and the surface protecting resin layer 18.

Embodiments according to the invention will be described with reference to the accompanying drawings.

Further, it is to be understood that various changes, alterations and improvements other than the following embodiments and those described above in concrete terms can be made on the basis of the knowledge of those skilled in the art without departing from the spirit of the present invention.

In order to form a reflective double-coated adhesive tape 10A, coating liquid for forming the ink layer on the surface of the following composition is prepared and applied to the base material sheet 11 (a polyester film of a thickness of 25 μm) by a known method and then dried, whereby the reflective ink layer 12 is formed.

| Coating Liquid for Forming Reflective Ink Layer 12 | Parts by weight |
|---|---|
| Acrylic resin | 60 |
| Glass beads | 20 |
| Pigment | 15 |
| Dispersing agent | 5 |
| Solvent | 200 |

After forming the reflective ink layer 12, a vapor deposited layer 13 is formed on the reflective ink layer 12 by a known method.

After the reflective ink layer 12 and the vapor deposited layer 13 have been formed on the base material sheet 11, an adhesive is applied to the vapor deposited layer 13 by a known method and then dried. Then, sticking peel paper on the adhesive, the adhesive layer 15 and the peel paper 16 are formed. Then, a transparent adhesive is applied to the base material sheet 11 by a similar known method and dried to form the adhesive layer 14.

In order to form the reflective double-coated adhesive tape 10B, the surface protecting resin layer 18 is applied to a surface of the base material sheet 11. 0n the surface protecting resin layer 18 is then applied the reflective ink layer 12 of the above composition, vapor deposited layer 13, adhesive layer 15, and peel paper 16 formed similarly to the above, and thereafter, the base material sheet 11 is removed. Removal may be, for example, by peeling the base sheet material 11 from the surface protecting resin layer 18. Then, a transparent adhesive is applied to the surface protecting resin layer 18 by a known method and dried, and thus the adhesive layer 14 is formed.

2. Production of Reflective Labels

Figure 3:
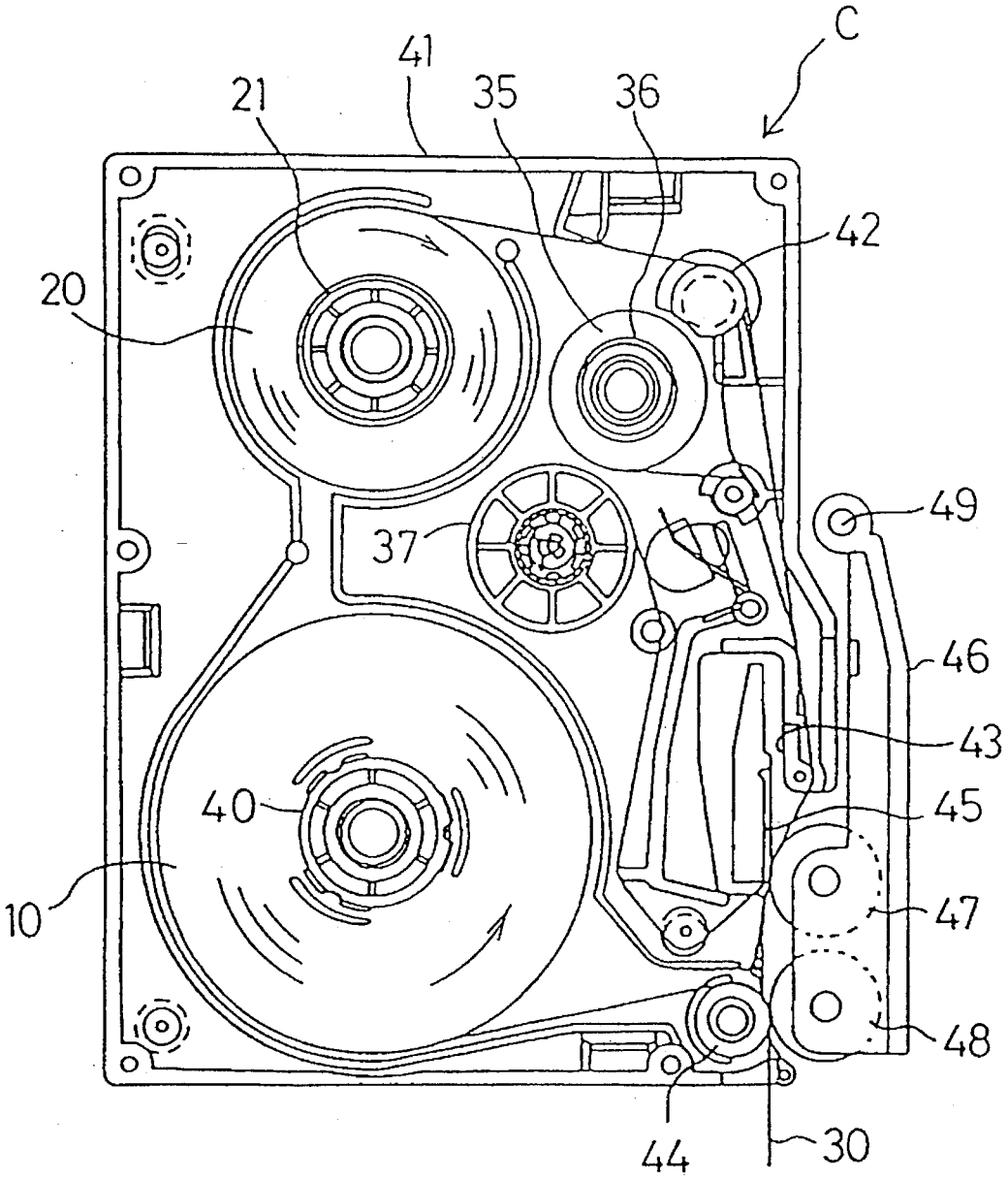
FIG. 3 is a diagram explanatory of a cassette of a reflective double-coated tape.

The method of producing the reflective label 30 using the reflective double-coated adhesive tape 10 and the cover film 20 produced as described above will be described below with reference to FIGS. 3 and 4. FIG. 3 is a plan view of a lower cassette case 41 showing a tape cassette C with its upper case removed, and FIG. 4 is a perspective view of a tape printing apparatus.

First, in loading the reflective double-coated adhesive tape 10 into the tape cassette C, the reflective double-coated adhesive tape 10 produced in the manner described above is cut to a width of 12 mm and wound on a tape spool 40 (both the outer diameter and the height of which are 12 mm) with the peel paper 16 on the outer side. The cover film 20 is also formed to the same width of 12 mm as that of the reflective double-coated adhesive tape 10 and wound on a tape spool 21. The tape spools 21 and 40 are set within the lower cassette case 41 as shown in FIG. 3 (The tape spool 40 is held for rotation by the lower cassette case 41 and an upper cassette case, not shown). There are also a ribbon supply spool 36 on which a thermal transfer ink ribbon 35 is wound, and a take-up spool 37 for taking up the ink ribbon 35, set also for rotation within the lower cassette case 41. The reflective double-coated adhesive tape 10, inside the lower cassette case 41, is wound off from the tape spool 40 and fed by a tape feed roller 44 which performs the feed operation in engagement with a tape feed shaft 51 installed on a tape printing apparatus 50, described below. The cover film 20 is guided from the tape spool 21 to an opening portion 43 along a tape guiding portion 42. The cover film 20 is also fed by the tape feed roller 44. Further, the ink ribbon 35 is led from the ribbon supply spool 36 to the take-up spool 37 through the opening portion 43, and the take-up spool 37 engaged with a ribbon take-up shaft 53 installed on the tape printing apparatus 50 performs the ink ribbon feeding operation. The ink ribbon 35 is held close to the cover film 20 in the proximity of the opening portion 43. In the opening portion 43, there is disposed a thermal head 45 (secured to a cassette mounting portion 52 in the tape printing apparatus 50, described later, and has a plurality of heating elements arranged longitudinally).

Opposite to the thermal head 45, there is installed a roller support member 46 (which is supported for rotation by a shaft 49 on the tape printing apparatus 50.) On the roller support member 46, a platen roller 47 and a press roller 48 are supported for rotation. When letters and the like are printed on the cover film 20 by the thermal head 45, the roller support member 46 is rotated counterclockwise round the shaft 49. Thereby, the platen roller 47 is pressed against the thermal head 45 so that printing operation of the letters and the like are much more ensured and, at the same time, the press roller 48 is allowed to press the tape feed roller 44 with the cover film 20 and the reflective double-coated adhesive tape 10 sandwiched therebetween. Thus, the reflective label 30 is fed out from the tape cassette C in cooperation with the rollers 48 and 44.

Figure 4:
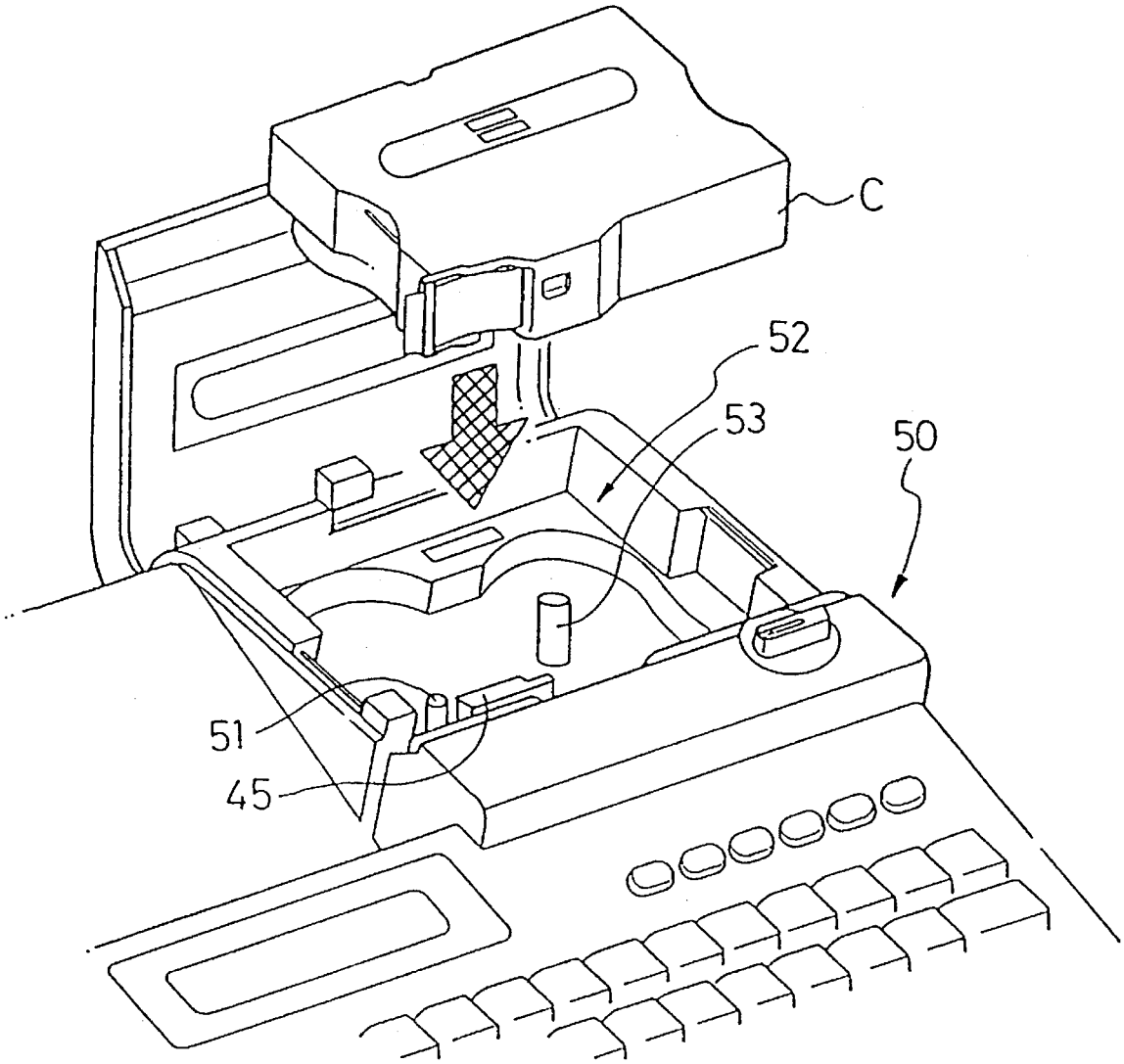
FIG. 4 is a perspective view of a tape printing apparatus.

The tape cassette C is set in the tape mounting portion 52 provided at the rear (to the right of FIG. 4) of the tape printing apparatus 50 (FIG. 4).

In the production of the reflective label 30, first, a command to start printing is issued to the tape printing apparatus 50 through predetermined operations. Then, the tape feed roller 44 and the take-up spool 37 are driven in synchronism with each other and the cover film 20 and the ink ribbon 35 are fed out from the spools 21 and 36, respectively. The heating elements of the thermal head 45 are selectively supplied with an electric current according to print data, whereby the cover film 20 and ink ribbon 35 put together are heated from the side of the ink ribbon 35 and the ink in the ink ribbon 35 is melted and desired letters and the like are transferred to the surface of the cover film 20 on the inner side of the cover film 20 when it was in the coiled state.

The cover film 20 with letters and the like printed thereon as described above and the reflective double-coated adhesive tape 10 are put together by cooperation of the tape feed roller 44 with the press roller 48 such that the adhesive layer 14 of the reflective double-coated adhesive tape 10 and the printed surface of the cover film 20 are stuck together, and then, it is discharged from the tape cassette C. The reflective label 30 formed of the cover film 20 and the reflective double-coated adhesive tape 10 may be cut by a cutter, not shown.

The reflective label 30 such as produced by the tape printing apparatus 50 as described above and having peel paper 16 peeled off can be stuck to a desired place by the adhesive force of the adhesive layer 15. More specifically, a printed tape of bright color, with desired letters printed thereon, can be stuck to any desired place.

3. Comparison of Sample of Reflective Label with Sample for Comparison

A sample of the reflective label such as produced by the tape cassette C (FIG. 3) containing the reflective double-coated adhesive tape 10, the cover film 20 of a transparent resin, and the ink ribbon 35 is loaded in a tape printing apparatus 50 of heat transfer printing type (P-touch/PT-2000 manufactured by Brother Industries, Ltd.). A desired print image 32 is formed on the cover film 20 by the thermal transfer printing method, and the transparent resin cover film 20 with the print image formed thereon is stuck to the above reflective double-coated adhesive tape 10.

The thus produced reflective label 30 gave good results as follows:

Heat-resistance: No problem in temperatures ranging from –40° C. to 200 ° C.;

Radiation-resistance: No problem when placed outdoors for six months;

Chemical-resistance: Not affected at all by organic solvents; and

Abrasion-resistance: Letters not erasable by a sand-rubber eraser or the like.

Figure 5:
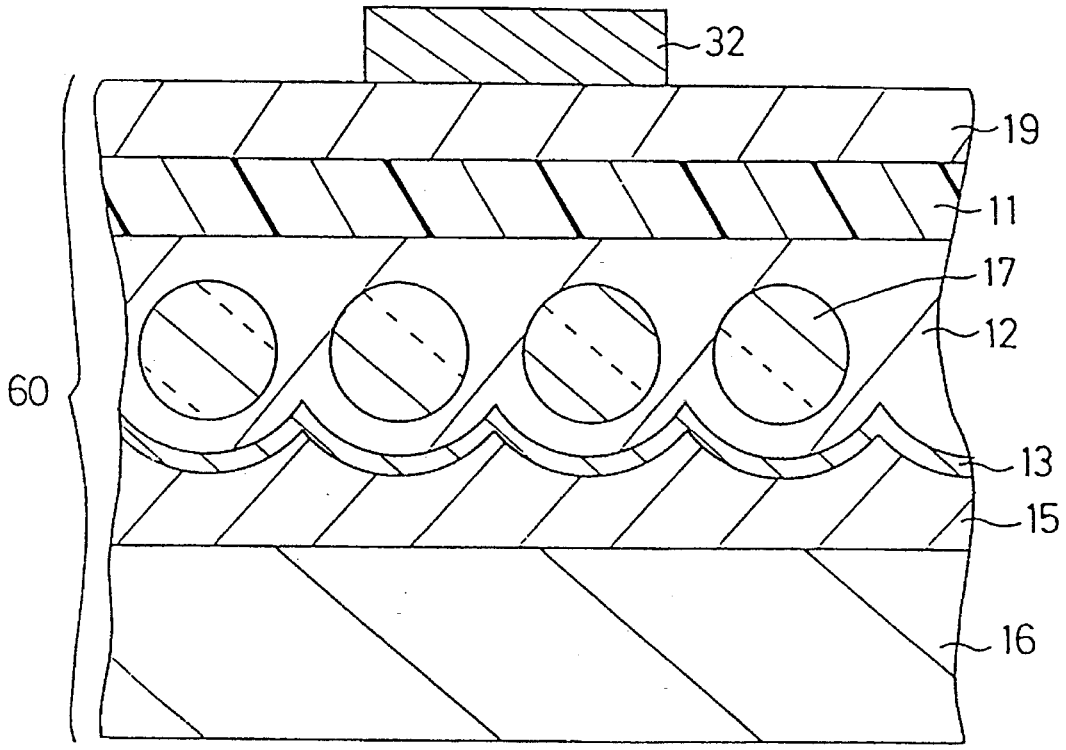
FIG. 5 is sectional view explanatory of a reflective tape as an example for comparison.
Figure 6:
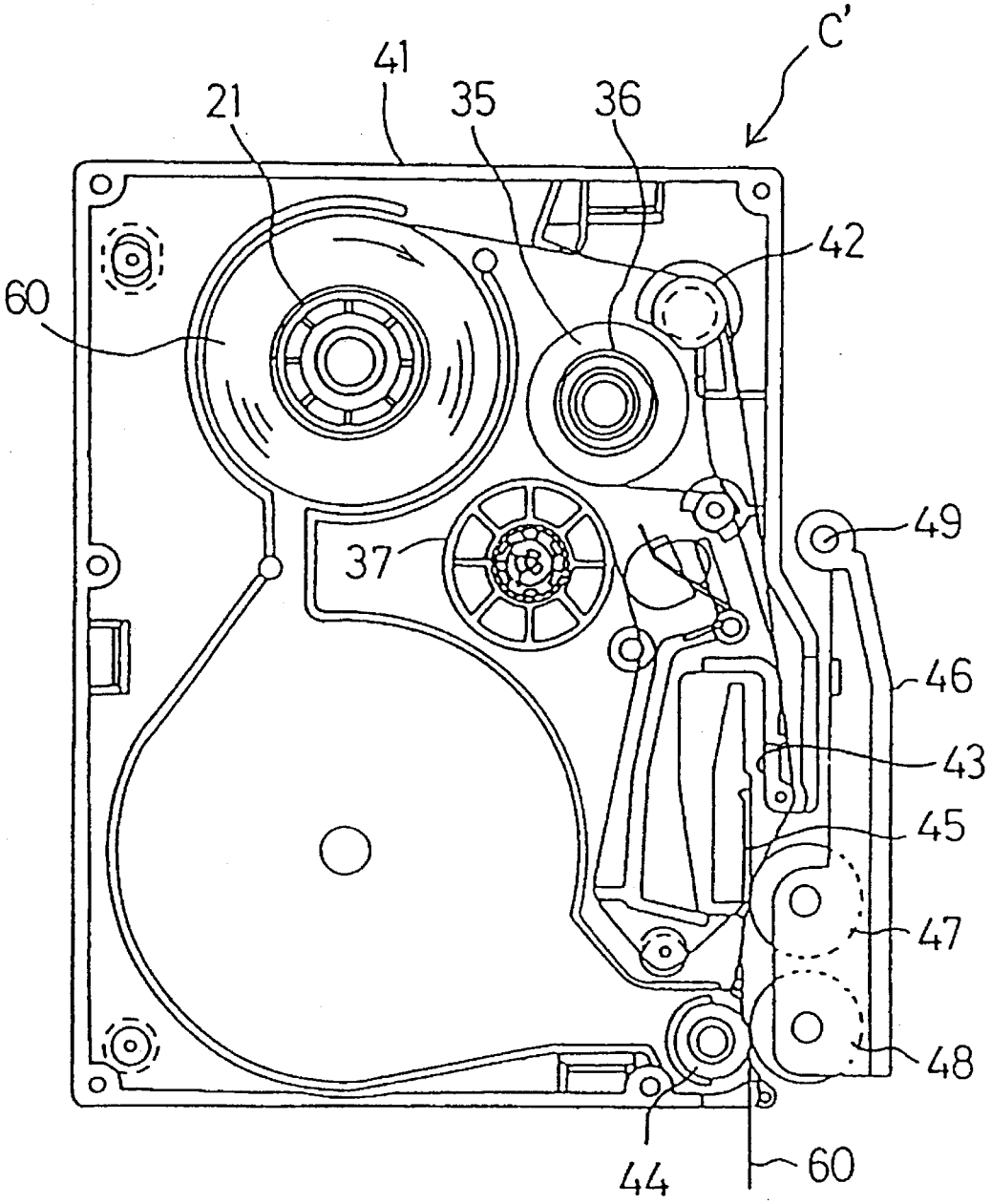
FIG. 6 is a diagram explanatory of a cassette of the reflective tape an example for comparison.

A reflective tape 60 as a sample for comparison as shown in FIG. 5 was produced by eliminating the adhesive layer 14 in the tape described in the above embodiment 1 and, instead, forming an image receiving layer 19, and then forming the print image 32 by loading a tape cassette C'containing the reflective tape 60 and ink ribbon as shown in FIG. 6 in the tape printing apparatus 50 and by directly printing the print image 32 on the image receiving layer 19 by the thermal transfer printing method. As the image receiving layer 19, polyester resin is used.

The thus produced reflective label using the reflective tape 60 as the sample for comparison gave the following results:

Heat-resistance: No problem in temperatures ranging from –40° C. to 150 ° C.;

Radiation-resistance: No problem when placed outdoors for four months;

Chemical-resistance: Letters disappeared when treated by some organic solvents; and Abrasion-Resistance: Letters were erased when rubbed by a sand-rubber eraser or the like.

By comparing the above results, it is shown that the reflective label 30 of the invention has improved resistance over the reflective label produced using the reflective tape 60 for comparison. Since the reflective label 30 of the invention has the cover film 20 and a structure such that the print image 32 is sealed up within the label, the cover film 20 prevents heat, radiations, chemicals, abrasion, and the like from directly impairing the print image 32 and the reflective ink layer 12, and further, the cover film 20 and the ultraviolet absorbent contained in the cover film 20 reduce adverse effects of such agents on the reflective label 30.

What is claimed is:

1. A cassette for producing a reflective print label comprising an ink ribbon, a cover film of a transparent resin and a reflective double-coated adhesive tape, said ink ribbon, cover film and reflective double-coated adhesive tape being wound on respective spools in said cassette.

2. The cassette according to claim 1, wherein said cassette further comprises means for supplying said ink ribbon and said cover film to a thermal head where a print image is formed on said cover film, and means for adhering said cover film having said print image formed thereon to said reflective double-coated adhesive tape.

3. The cassette according to claim 1, wherein said reflective double-coated adhesive tape comprises a backing member, a reflective ink layer formed on one surface of said backing member, a vapor deposited metallic layer formed on said reflective ink layer, a first adhesive layer applied to and formed on said vapor deposited metallic layer, and peel paper stuck onto said first adhesive layer, and further, a second transparent adhesive layer applied to and formed on the surface of said backing member opposite to the surface on which said reflective ink layer is formed.

4. The cassette according to claim 3, wherein said backing member is formed of a transparent resin sheet having a thickness of 6–100 μm.

5. The cassette according to claim 4, wherein said resin sheet comprises polyester, polypropylene, polyethylene, polycarbonate, polystyrene, or mixtures thereof.

6. The cassette according to claim 3, wherein said backing member is a surface protecting layer formed of an acrylic resin.

7. The cassette according to claim 3, wherein said reflective ink layer has a thickness of 5–200 μm and comprises a coloring agent for coloring said reflective ink layer, light scattering particles for scattering light, and a resin binder for binding said coloring agent and said light scattering agent.

8. The cassette according to claim 7, wherein said light scattering particles are particles having diameters ranging from 30 to 100 μm and contained in said reflective ink layer in an amount of 20–70 wt %.

9. The cassette according to claim 8, wherein said light scattering particles are contained in said reflective ink layer in an amount of 30–50 wt %.

10. The cassette according to claim 7, wherein said light scattering particles comprise glass beads, quartz beads, or resin particles with high transparency.

11. The cassette according to claim 1, wherein said reflective print label is produced by using an ink ribbon, said reflective double-coated adhesive tape, and said cover film, wound on respective spools, in a tape containing cassette to be removably loaded in a tape printing apparatus.

12. The cassette according to claim 3, wherein said vapor deposited metallic layer has a thickness of 1–20 nm and deposited by evaporation on said reflective ink layer.

13. The cassette according to claim 1, wherein said cover film is formed of a transparent resin film and has a thickness of 10–100 μm.

14. The cassette according to claim 13, wherein said cover film has a thickness of 25–75 μm.

15. The cassette according to claim 1, wherein said cover film is a resin film in which an ultraviolet absorbent is scattered or dissolved.

16. The cassette according to claim 15, wherein said ultraviolet absorbent is a benzotriazole derivative.

17. The cassette according to claim 16, wherein said benzotriazole derivative is selected from the group consisting of 2-(5-methyl-2-hydroxyphenyl) benzotriazole, 2-[2-hydroxy-3,5-bis(α, α-dimethylbenzyl) phenyl]-2H-benzotriazole, 2-(3,5-di-t-butyl-2-hydroxyphenyl) benzotriazole, 2-(3-t-butyl-5-methyl-2-hydroxyphenyl)-5-chlorobenzotriazole, 2-(3,5-di-t-butyl-2-hydroxyphenyl)-5-chlorobenzotriazole, and 2-(3,5-di-t-amyl-2-hydroxyphenyl) benzotriazole.

18. The cassette according to claim 15, wherein said reflective double-coated adhesive tape further comprises a backing member, a reflective ink layer formed on one surface of said backing member, a vapor deposited metallic layer formed on said reflective ink layer, a first adhesive layer applied to and formed on said vapor deposited metallic layer, and peel paper stuck on said first adhesive layer, and further, a second transparent adhesive layer applied to and formed on the surface of said backing member opposite to the surface on which said reflective ink layer is formed.

19. The cassette according to claim 15, wherein said reflective print label is produced with the use of an ink ribbon, said reflective double-coated adhesive tape, and said cover film, wound on respective spools, in a tape containing cassette to be removably loaded in a tape printing apparatus.

20. The cassette according to claim 1, wherein said print image is formed on said one surface of the cover film by thermal transfer of ink from an ink ribbon using a thermal head.

* * * * *